United States Patent [19]

Fennekels et al.

[11] 3,958,926

[45] May 25, 1976

[54] RELIEF PRINTING ACRYLIC PILE FABRIC WITH DI-BETA-CYANOETHYL FORMAMIDE TO SIMULATE ANIMAL SKINS

[75] Inventors: Peter Fennekels, Kempen-Huls; Ernst Waltmann, Krefeld, both of Germany

[73] Assignee: Firma Girmes-Werke AG, Grefrath-Oedt, Germany

[22] Filed: May 29, 1974

[21] Appl. No.: 474,195

[30] Foreign Application Priority Data

May 29, 1973 Germany ..... 2327290
June 30, 1973 Germany ..... 7324371[U]

[52] U.S. Cl. ..... 8/15; 8/1 XB; 8/114.6; 8/115

[51] Int. Cl.[2] ..... D06P 5/00

[58] Field of Search ..... 8/114.6, 115, 17

[56] References Cited

UNITED STATES PATENTS

| | | | |
|---|---|---|---|
| 705,977 | 7/1902 | Timme | 8/114.6 |
| 1,655,414 | 1/1928 | Flory | 8/114.6 |
| 1,783,608 | 12/1930 | Ellis et al. | 8/114.6 |
| 1,818,505 | 8/1931 | Rivat et al. | 8/114.6 |
| 1,980,191 | 11/1934 | Dickie | 8/114.6 |
| 2,815,558 | 12/1957 | Bartovics | 8/54.2 UX |
| 2,875,504 | 3/1959 | White | 8/114.6 UX |

*Primary Examiner*—Donald Levy
*Attorney, Agent, or Firm*—Mandeville and Schweitzer

[57] ABSTRACT

A method is provided for decorating or treating the pile side of pile fabrics to imitate naturally occurring designs and/or configurations such as animal skins and hides, for example. The pile surface is first color printed by a tinted printing paste and then relief-printed, in a manner related to the color printing, using a printing paste containing a shrinking or carbonizing agent in the proportion of within the range of between about 60–400g. per kilogram of printing paste. The agent used, which is non-volatile or substantially so, can contain O-phenyl-phenol or diphenyl ether, and also dyestuffs. The twice-printed fabric is then steamed.

3 Claims, 1 Drawing Figure

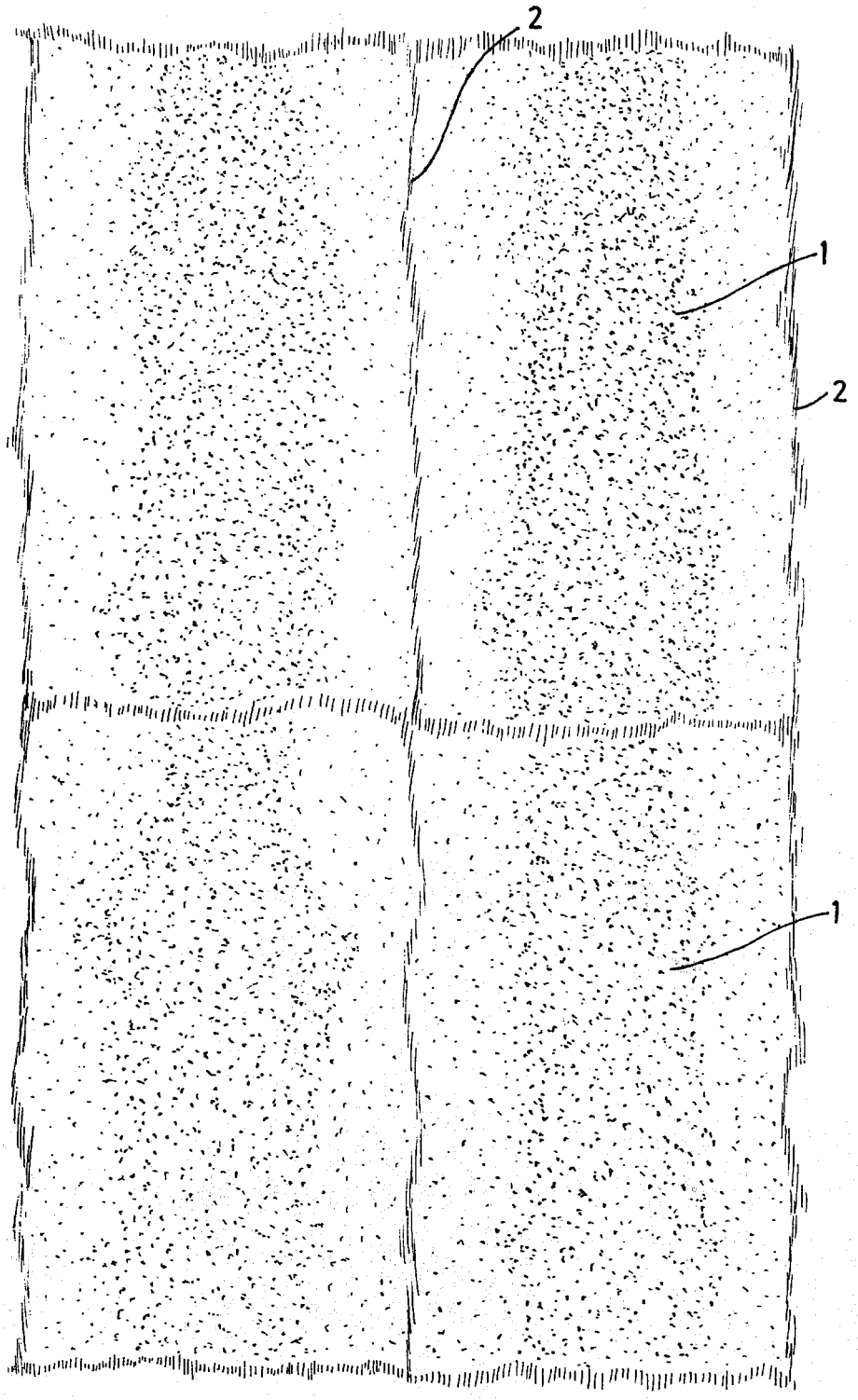
2
1
2
1

RELIEF PRINTING ACRYLIC PILE FABRIC WITH DI-BETA-CYANOETHYL FORMAMIDE TO SIMULATE ANIMAL SKINS

BACKGROUND OF THE INVENTION

This invention relates to a method for decorating the pile side of pile fabrics, the decorating being carried out by printing the nap with a printing paste in accordance with the desired pattern, followed by steaming of the pile fabric. This method is especially intended for making imitation animal skins or hides and may be carried out, for example, with the use of pile fabrics, of which the nap or pile surface may consist, for example, wholly or partly of polyacrylic, modified polyacrylic, and/or poly-as.-dicyanoethylene (glossy or mat), or which may indeed consist of cellulose filaments or fibers, such as cellulose spun filaments or cellulose spun fibers (glossy or mat).

The skin pattern of a number of natural animal skins or hides exhibits, in addition to the typical hue, toning or shading, a relief-type patterning of the skin surface. It is also known that by the stitching together of small animal skins or of pieces of skins to constitute larger strips of skin or hide, relief-like appearing patterns of the surface of the hide may be produced at the seams. No success has yet been achieved when making imitation animal skins, in imitating both the basic shading, and also the associated relief-type appearing pattern in a simple and naturally effective manner.

Attempts have already been made, when making imitation animal skins from pile fabrics by a cutting out or weaving process followed by printing of the pile fabric, to produce the hue or toning of the desired animal skin and also the associated relief formation to suit one another. The reverse process has also been attempted, the pile fabric being first printed and then a treatment producing a relief design and having a relationship to the printed pattern being carried out. In neither of these cases has it been possible, however, to produce imitation animal skins having a real natural effect. Instead, a lack of agreement between the hue or toning and the relief has resulted, in the finished structure, extending over the whole sheet in both the warp and weft directions.

It is the objective of the invention, using known printing techniques, such as roller printing, rotational template printing, flat film printing and the like, to produce imitation animal hides from pile fabrics which shall to a great extent agree with the natural animal skin structure both with regard to the hue or toning, and also with regard to the relief-like structure of the surface.

SUMMARY OF THE INVENTION

To solve this problem, it is proposed in a method of the type initially named that, by using a known printing technique, first the hue, toning or shading design is printed using a tinted printing paste, and then in the same printing technique and in an appropriate figurative relationship to the colored picture already printed, a relief picture is printed using a printing paste which contains a proportion of within the range of between about 60g and 400g, and preferably 100g per kilogram of the paste, of a fiber swelling and shrinking agent which is not, or only sparingly, volatile during subsequent steaming and then applying a steaming application. This printing paste, which is applied after the tinted printing paste in a second printing operation carried out sequentially and synchronously to the first, contains, in addition to water and conventional thickening agents, the agent possessing a swelling, shrinking or carbonizing effect, but not a dissolving effect, upon the fibers of the pile fabric, and which exhibits no, or only very little volatility during the subsequent steaming.

The effect of the printing paste which produces the relief picture becomes apparent, in the steaming process following the printing operation, in a swelling of the synthetic fibers constituting the pile surface or nap, combined with a shrinking of the synthetic fibers of the pile surface at the regions printed with this paste.

In this manner, a proper overall surface texture is obtained providing a good imitation of the natural skin structure. The structure of a sheet of skin composed by sewing together small skins or pieces of skin, can also be very well imitated by the method according to the invention.

Preferably, di-beta-cyanoethyl formamide (trade name Glyezin PFD) may be used for the fiber swelling and shrinking agent especially suited for the invention and developing its effect during the steaming stage, when treating synthetic fibers of the polyacrylic, modified polyacrylic (such as, polyacrylonitrile) and poly-as.-dicyanoethylene types. Other agents which may be used for the method according to the invention are, for example, O-phenyl-phenol (trade name Levegal OPS) and diphenyl ether (trade name Dilatin) and also methyl dichlorophenoxy acetate and N-butyl phtalimide.

It is known that fiber swelling agents of this type may be added to the printing paste in small proportions of, for example, from 5 to 30 grams per kilogram of printing paste depending upon the article, so as to act as a fixing accelerator when printing textile materials containing synthetic fibers of said type. It is not, however, possible in this way to obtain the relief effect according to the invention, since for this purpose a larger concentration of the fiber swelling agent is necessary and also because this agent must be applied in accordance with a pattern differing from that for the hue or shade of the animal skin to be imitated.

Volatile solvents or swelling agents suitable for polyacrylic or modified acrylic fibers, such as dimethyl formamide, dimethyl sulphoxide, propylene carbonate, etc., which have been recommended in German Pat. Specification No. 2,220,763 for the treatment of a pile surface consisting of acrylic fibers, cannot be considered for the method according to this invention, because they are too drastically volatile during the steaming process following the printing operation.

The printing paste used for producing the relief pattern and, therefore, containing the fiber swelling agent may, in addition, contain dyestuffs and the necessary further additives for the application of dyestuffs, such as acetic acid, ammonium sulphate and the like, so that by the use of this printing paste, in addition to the relief effect, the tinted hue, tone or shade of the pile surface can also be modified or amplified.

If the pile surface or nap of the pile fabric consists of cellulose spun filaments or cellulose spun fibers (glossy or mat), an agent having a carbonizing effect upon the cellulose fibers or filaments is used, being applied from the pile side onto the pile fabric. Depending upon the adjusted viscosity value of the printing paste containing this agent, and depending upon the degree of engraving of the rollers used for applying the printing paste, a more or less pronounced burning out effect is achieved in this manner, and therefore, a more or less pronounced relief picture on the pile surface of the pile fabric. The back of the pile fabric consists preferably wholly or partly of fibers which are insensitive to the carbonizing agent, for example, of polyester fibers.

The relief patterns of differing depths to be achieved according to the invention become clearly apparent especially in high-nap pile fabric goods having a pile depth of approximately 5 mm to approximately 100 mm and more.

According to a further preferred feature of the invention, the hue, toning or shading consists of fashionable fancy patterns, that is to say not of colors which copy a natural animal skin, but here again, in the manner of the invention, a relief-like patterned configuration and thus a relief-like structure of the pile surface are provided.

The drawing shows a view of a portion of a pile fabric sheet according to the invention, which is provided as an imitation of a skin assembled by sewing together chinchilla skins. The pile surface consists of a fibrous viscose mat 60/40 den, while the basic fabric which carries the pile surface and is not shown in the drawing has been made from 50 percent cotton-50 percent polyester mixed yarn.

The drawing clearly shows that the pile surface comprises portions 1, having a hue or toning corresponding to natural chinchilla skins with strip-like sections 2 between them possessing the appearance of sewn seams. The imitations of the stitched seams have been produced by printing the pile fabric sheet with aluminum sulphate paste upon the nap side; this paste has a carbonizing effect, during the process of steaming the pile fabric sheet, upon the fibers of the pile surface in the region of the imitation seams.

Pile fabrics in the context of this invention may be fabrics made in accordance with the known techniques of weaving, knitting, crocheting, tufting, stitching technique or the like, having a pile surface of fibers of the above-named types. The burning out effect which produces the relief effect may be carried out, in the case of a nap consisting of cellulose filaments or fibers, for example, by using aluminum sulphate, aluminum chloride or benzene sulphonic acid.

The following example serves for further explaining the invention and indicates how the desired relief patterns are produced with synthetic fibers by the use of a swelling agent.

EXAMPLE

A pile fabric made by the double plush weaving method, of which the rear side consists of a weave of cotton yarn for both warp and woof, and which comprises a nap warp of a mixed yarn containing 70 percent polyacrylic fibers (trade name Dralon) and 30 percent modified acrylic fibers (trade name Verel), was printed on a roller printing machine with a 3-color design in the manner of a rabbit skin. Downstream of the color printing rollers was mounted a printing roller which applied a paste of the following composition:

| | |
|---|---|
| 100 gr. | Di-beta-cyanoethylformamide (trade name Glyezin PFD) |
| 350 gr. | High grade flour derivative thickening agent 20% (trade name Diaprint 1024/P |
| Remainder | Water |
| 1000gr. | |

This relief-giving print was designed to simulate a rabbit skin pattern, so that the fiber shrinkage at the printed positions resulted in the pattern of a sheet of skin made up from a large number of individual skins.

This was followed by drying, by 30 minutes steaming at 100°C, then washing and renewed drying. The material was then subjected to the usual finishing treatment for such pile fabric articles, including scraping, fleecing and cutting.

We claim:

1. A process for producing simulated animal skins by the sequential treatment to the pile side of pile fabrics, the steps which comprise a. first selecting a pile fabric with the nap thereof being a member selected from the group consisting of polyacrylic pile fabrics, modified polyacrylic pile fabric and poly-as.-dicyanoethylene pile fabric;

b. first passing in a first treatment step said fabric from said selecting step through a first treatment zone and applying to the pile surface thereof a tinted printing paste to selected areas for providing the hue, tone and shade of said simulated animal skins;

c. after said first passing step, passing in a second treatment step said selected pile fabric through a second treatment zone and applying to the pile surface thereof a printing paste to selected areas, said printing paste containing within the range of between about 60 grams and 400 grams per kilogram of printing paste di-beta-cyanoethyl formamide, and d. after said second treatment step, applying steam to the pile side of said selected pile fabric.

2. A method as recited in claim 1, in which a. said second treating step is carried out with a printing paste containing 100 grams of said di-beta-cyanoethyl formamide per kilogram of said printing paste.

3. A method as recited in claim 1, in which a. said second treatment step is carried out with a paste also containing dyestuffs and dyestuff transferring additives.

* * * * *